US006602168B2

(12) United States Patent
Duke

(10) Patent No.: US 6,602,168 B2
(45) Date of Patent: Aug. 5, 2003

(54) FLEXION EXTENSION EXERCISER

(76) Inventor: John H. Duke, 11 Elton St., Providence, RI (US) 02906

( * ) Notice: Subject to any disclaimer, the term of this patent is extended or adjusted under 35 U.S.C. 154(b) by 317 days.

(21) Appl. No.: 09/803,616

(22) Filed: Mar. 8, 2001

(65) Prior Publication Data

US 2001/0027150 A1 Oct. 4, 2001

Related U.S. Application Data

(60) Provisional application No. 60/187,914, filed on Mar. 8, 2000.

(51) Int. Cl.[7] ..... A63B 69/06; A63B 22/00

(52) U.S. Cl. ..... 482/72; 482/51; 482/62

(58) Field of Search ..... 482/51–53, 57, 482/70, 79–80, 71, 62, 72, 73

(56) References Cited

U.S. PATENT DOCUMENTS 4,679,786 A * 7/1987 Rodgers ..... 482/70
5,611,758 A * 3/1997 Rodgers, Jr. ..... 482/57
6,361,479 B1 * 3/2002 Hildebrandt et al. ..... 482/72
6,527,685 B2 * 3/2003 Endelman et al. ..... 482/121

* cited by examiner

*Primary Examiner*—Stephen R. Crow

(57) ABSTRACT

A total body exercise machine including a fixed seat and longitudinal frame members on which travel a footrest slide carriage and a handle slide carriage. A tensile element coordinates movement of the slide carriages in opposite directions at a constant speed ratio. In the preferred embodiment resistance to slide carriage movement is provided by one or more friction brakes coupled to a slide carriage by a pivot frame oriented at an acute angle to the longitudinal frame member on which the carriage travels. The brake thereby provides more resistance in one direction of travel than the other, and the magnitude of resistance is controlled by a small static force bearing on the pivot frame. In one embodiment a logic controller electronically controls this small static force by means of a force feedback loop to simulate a kinesthetic flywheel effect and to reduce shock loading. Additional means are provided to record, transmit, and receive data from a remote data processing device which aggregates and summaries such data in a user accessible medium.

17 Claims, 12 Drawing Sheets

Fig. 7c

```
500  TC = 0
510  WC = 0
520  WMAX = 0
530  X2 = 0
540  X5 = 0
550  N = 1
580  WC = 0
585  IF D(N) = 0  THEN  N = 1
600  X3 = 0
605  PAUSE TI
610  GET FM
615  IF FM < 0 THEN  GOTO  700
620  GET  X1
625  WC= WC + FM * X1
630  SUBROUTINE  900
635  F = ID * (X1–X2) + DD * X1E3 + FC
640  X3 = X3 + X1
645  IF X3 < XS  THEN  IF  F * X3/XS > FC  THEN F = F * X3/XS
650  APPLY  F  TO EXERTER 220
655  X2 = G * X1
660  X5 = G * X5
665  IF TEND > 0  AND  TC > TEND  THEN  GOTO 850
670  IF WEND > 0  AND  W > WEND  THEN  GOTO 850
675  IF ABS VAL(FM) <  (SMALL NUMBER)  THEN  GOTO 700
680  GOTO  600
700   X6 = 0
705  PAUSE  TI
710  GET FM
720  GET  X4
725  WC = WC + FM * X4
730  SUBROUTINE  900
735  F =  IR * (X4–X5) + DR * X4E3 + FC
740  X6 = X6 + X4
745  IF X6 < XS  THEN  IF  F * X6/XS > FC  THEN  F  =  F  *  X6/XS
750  APPLY  F  TO  EXERTER 220
755  X5 = G * X4
760  X2 = G * X2
765  IF  TEND > 0 AND TC > TEND  THEN  GOTO  850
770  IF  WEND > 0 AND W > WEND  THEN  GOTO  850
775  IF  ABS VAL(FM) < (SMALL NUMBER)  THEN  GOTO 800
780  GOTO  700
```

Fig. 7c Continued

```
800   IF P = 2 AND WC > WMAX THEN WMAX = WC
805   WT = WT + WC
810   DISPLAY WC AND HR
815   RECORD TC AND WC AND HR
820   IF P > 2 THEN N = N + 1
825   GOTO 580
850   DISPLAY RESULTS ON DISPLAY 130
855   TRANSMIT RESULTS TO REMOTE COMPUTER 256

900   IF P > 2 THEN GOTO 950

905   IF P = 1 AND HR >= D(3) AND HR <= R(3) THEN DD = D(1) AND
      DR = R(1) AND RETURN
910   IF P = 1 AND HR < D(3) THEN DD = D(1) * D(2) * D(3)/HR AND
      DR = R(1) * R(2) * D(3)/HR AND RETURN
915   IF P = 1 AND HR > R(3) THEN DD = D(1) * D(2) * R(3)/HR AND
      DR = R(1) * R(2) * R(3)/HR AND RETURN

930   IF P = 2 AND WMAX = 0 THEN GOTO 950
935   IF P = 2 AND FM > 0 THEN GOT0 950
940   IF P = 2 AND WC < WMAX * (D(3))/100 THEN
                IF N = 1 THEN N = 2 AND WMAX = 0 OR
                IF N = 2 THEN N = 1 AND WMAX = 0

950   DD = D(N) AND DR = R(N) AND RETURN
```

FLEXION EXTENSION EXERCISER

This application claims the benefit of Provisional application Ser. No. 60/187,914, filed Mar. 8, 2000.

FIELD OF INVENTION

This invention relates to exercise devices which provide total body resistance to action of both extension and flexion muscle groups.

BACKGROUND OF THE INVENTION

The importance of exercise in maintenance of human health is well established in the prior art. The primary benefits include cardiovascular conditioning, strength development, and flexibility development. For cardiovascular conditioning the most efficient exercises are so-called total body type in which oxygen is metabolized throughout the body, so total oxygen uptake is not limited by fatigue in any individual muscle group. For strength development efficiency requires convenient means to vary loads in both directions. Development of flexibility requires that an exercise be performed a wide range of motion. Also established in the prior art is the value of a so called kinesthetic momentum effect in providing an enjoyable continuous exercise.

In the prior art many total body exercisers providing a kinesthetic momentum effect only offer significant resistance in one direction, for example rowing machines utilizing a one-way clutch to drive a flywheel. They provide extension resistance in the legs but minimal flexion resistance, and vice-versa in the arms. Several devises which do provide extension and flexion resistance employ pivoting frame members, including Bolf (U.S. Pat. No. 5,9913,752) and Scott (U.S. Pat. No. 5,178,599). These however do not provide a kinesthetic momentum effect or a wide range of motion. Others, such as Olschansky et al. (U.S. Pat. Nos. 5,145,479 and 5,284,462) utilized foot and/or hand driven rotary crank means, which also do not provide a wide range of motion. Other extension/flexion devices, such as Krukowski (U.S. Pat. No. 4,628,910) do not provide total body exercise. Mastropaolo (U.S. Pat. No. 3,572,700) describes a devise providing total body extension/flexion exercise over a wide range of motion which utilizes a sliding carriage for supporting the body and a one-way clutch means for switching direction of load which is not integral to the load means.

OBJECTS AND ADVANTAGES

The object of the present invention is to provide a device for total body exercise which may be performed over a wide range of motion with provision for independent control of load over a wide range in both extension and flexion directions. A further object is to provide a device with a fixed seat so that work done by the upper body is independent of work done by the lower body. Another object is to provide a load control means which provides both a means to reduce shock loads at the beginning of each phase of operation and a simulated kinesthetic momentum effect not requiring a mechanical energy storage means such as a flywheel. Another object is to provide a load control means which provides an integral capability of measuring work output so that it may be economically recorded and summarized. A final object of the invention is to provide a device providing the above benefits which may be economically manufactured.

BRIEF DESCRIPTION OF THE DRAWINGS

FIG. 7*c* is logic sequence describing operation of the automatic resistance adjustment subassembly during an entire workout.

DETAILED DESCRIPTION OF THE INVENTION

Figure 1:
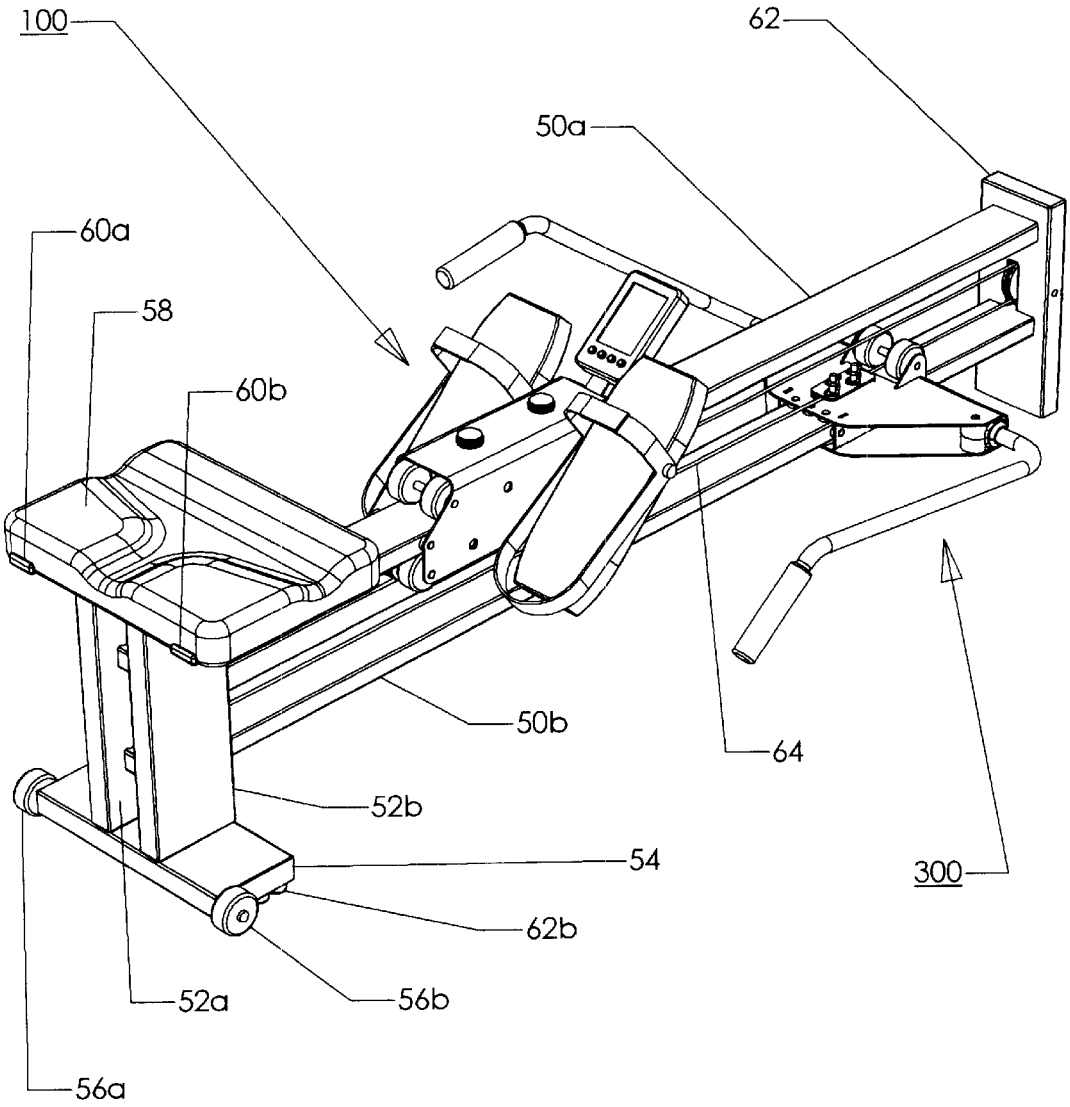
FIG. 1 shows a top perspective view of the exerciser.

First referring to FIG. 1, a footrest subassembly 100 is slidably mounted on a first frame member 50*a* and a handle subassembly 300 is slidably mounted on a second frame member 50*b*. Frame members 50*a* and 50*b* are supported at a first end by a pair of supports 52*a* and 52*b*. Frame members 50*a* and 50*b* are supported at their opposite end by a support 62. As seat 58 is mounted on a first end of supports 52*a* and 52*b*. The opposite end of supports 52*a* and 52*b* connect to a base member 54. At a first end of base member 54 are attached a first set of floor bumpers 62*a* not shown and a first dolley wheel 56*a*. At the opposite end of base member 54 are attached a second set of floor bumpers 62*b* and a second dolley wheel 56*b*. Integral to seat 58 are alternate floor bumpers 60*a* and 60*b*. A tensile element 64 links footrest subassembly 100 to handle subassembly 300 in a manner further described below with reference to FIG. 2*a* and FIG. 2*b*.

Figure 2A:
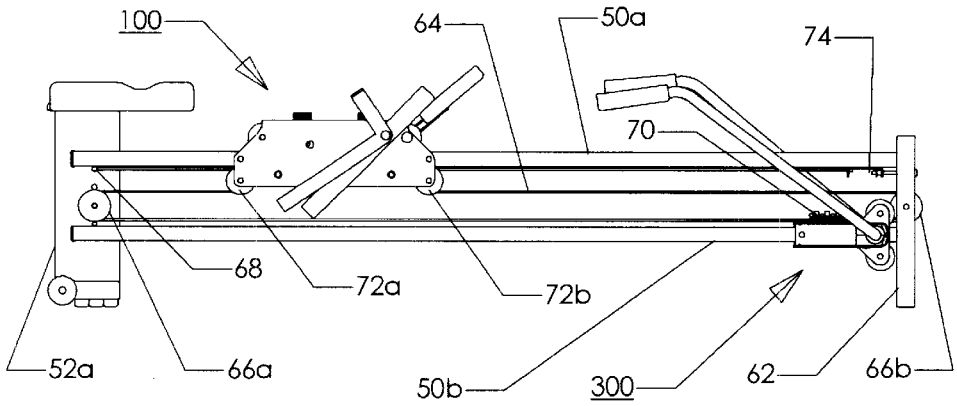
FIG. 2*a* is a side view of the exerciser in a beginning body position with components removed to show detail of power transmission.
Figure 2B:
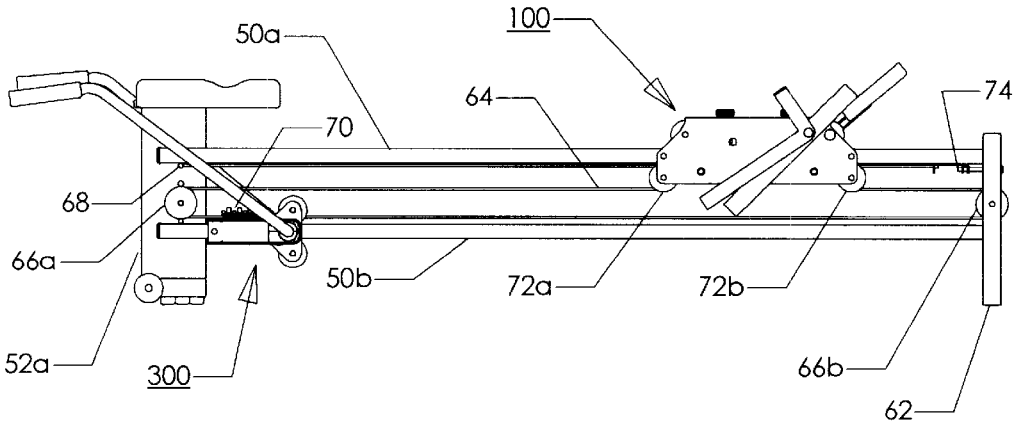
FIG. 2*b* is another side view of the exerciser in an ending body position with components removed to show detail of power transmission.

Now referring to FIG. 2*a* and FIG. 2*b*, in which support 52*b* is removed for clarity, tensile element 64 attaches to a pin 68 mounted between supports 52*a* and 52*b*. Tensile element 64 then runs substantially parallel to frame member 50*a* to where it turns about a pulley 72*a* rotatably mounted to footrest subassembly 100. Pulley 72*a* is concentric to but here concealed by wheel 106*b* designated below. From pulley 72*a* tensile element 64 then runs back again substantially parallel to frame member 50*a* to where it turns about a pulley 66*a* which is rotatably mounted between supports 52*a* and 52*b*. From pulley 66*a* tensile element 64 then runs substantially parallel to frame member 50*b* to where a clamp 70 connects it to handle subassembly 300. From clamp 70 tensile element 64 then continues substantially parallel to frame member 50*b* to where it turns about a pulley 66*b* rotatably mounted within support 62. Tensile element 64 then returns substantially parallel to frame member 50*a* to a pulley 72*b* rotatably mounted to footrest subassembly 100. Pulley 72*b* is concentric to but here concealed by wheel 106*d* designated below. From pulley 72*b* tensile element 64 then runs back again substantially parallel to frame member 50*a* to where it terminates at a tension bracket 74 which is adjustably linked to support 62.

The positions of footrest subassembly 100 and handle subassembly 300 indicated in FIG. 2*a* reflect the respective positions of a user's feet and hands at the beginning of the exerciser's "drive" phase. The positions of those subassemblies indicated in FIG. 2*b* reflect the end of the drive phase which begins the exerciser's "recovery" phase, which returns them to their FIG. 2*a* positions. During both phases of motion handle subassembly 300 slides along frame member 50*b* in the opposite direction from and for substantially twice the distance that footrest subassembly 100 slides along frame member 50*a*.

Figure 3A:
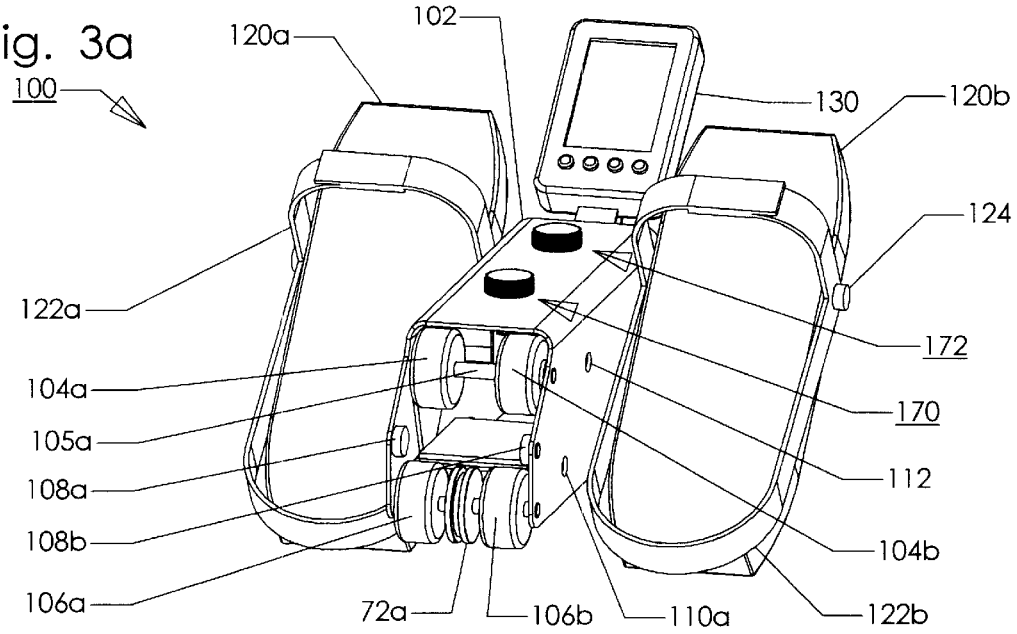
FIG. 3*a* shows a perspective view of the footrest subassembly with manual resistance adjustment.
Figure 3B:
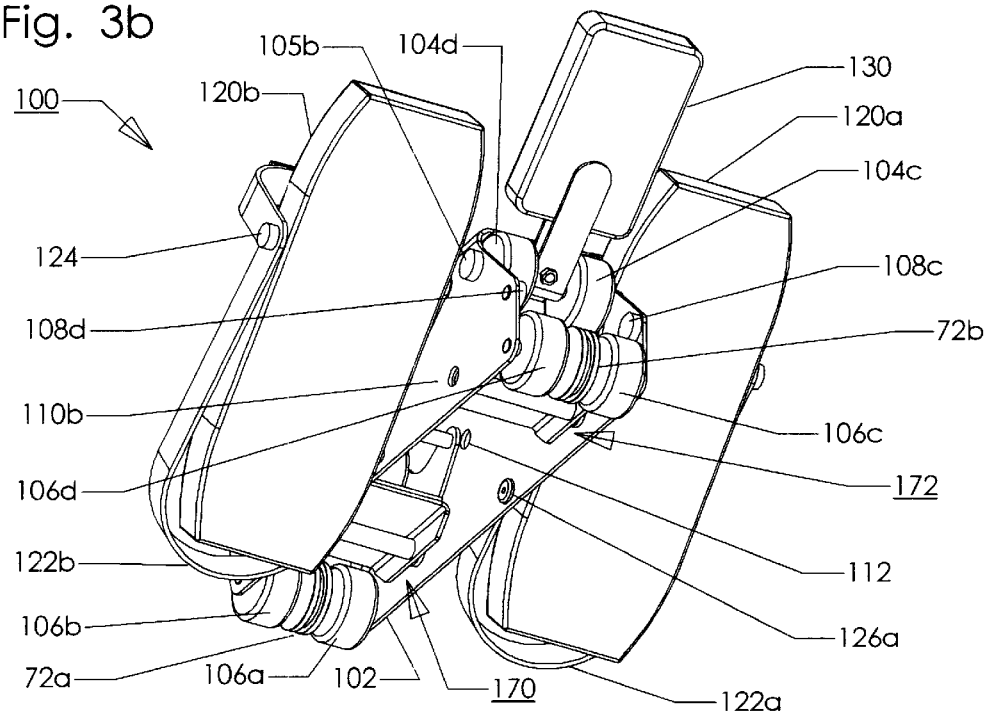
FIG. 3*b* shows another perspective view of the footrest subassembly with manual resistance adjustment.
Figure 3C:
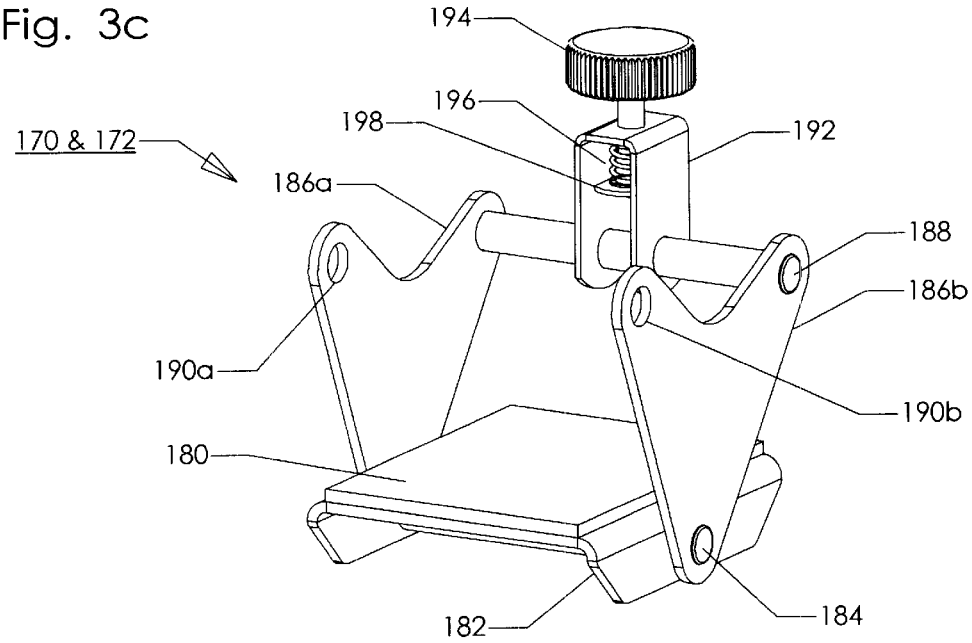
FIG. 3*c* is a detail view of the manual resistance adjustment subassembly.

Now referring to FIG. 3*a* and FIG. 3*b*, which show the preferred manual resistance adjustment embodiment of the exerciser, footrest subassembly 100 includes a footrest support housing 102 within which are suspended a pair of manual resistance adjustment subassemblies 170 and 172 pictured in FIG. 3*c*.

Further referring to FIG. 3*a* and FIG. 3*b*, a set of upper wheels 104*a* and 104*b* rotate on an axle 105*a* which is positioned within a first end of housing 102 so wheels 104*a* and 104*b* may roll on the top surface of frame member 50*a*. Similarly a second set of upper wheels 104*c* and 104*d* rotate on an axle 105*b* which is positioned within a second opposite end of housing 102 so wheels 104*c* and 104*d* may also roll on the top surface of frame member 50*a*. Likewise a group of lower wheels 106*a*, 106*b*, 106*c*, and 106*d* is rotatably mounted within housing 102 where they may roll on the bottom surface of frame member 50*a*. Pulley 72*a* designated above is rotatably mounted concentric to and between lower wheels 106*a* and 106*b*. Pulley 72*b* designated above is rotatably mounted concentric to and between lower wheels 106*c* and 106*d*. Also mounted within housing 102 are a set of anti-friction pads 108*a*, 108*b*, 108*c*, and 108*d*, located where they may contact the side surfaces of frame member 50*a*. A set of access holes 110*a*, 110*b*, and 112 pierce both opposing sides of housing 102. A support rod 124 projects from both sides of housing 102 and supports a left footboard 120*a* and a right footboard 120*b*. Footboard 120*a* is further fastened to housing 102 by a screw 126*a* and footboard 120*b* is further fastened to housing 102 by a screw 126*b* not shown. Pivotably mounted to rod 124 is a left Bootstrap 122*a* and a right Bootstrap 122*b*. A display device 130 is mounted to resistibly pivot about axle 105*b*. In this embodiment display 130 shows elapsed time, drive/recovery cycles per minute and total cycle count. A switch not shown connects to display 130 and detects the change in rotation direction of wheels 104*c* and 104*d* to signal drive/recovery cycle frequency.

Manual resistance adjustment subassemblies 170 and 172 are identical in the preferred embodiment of the exerciser. Depicted in FIG. 3*c*, they include a friction pad 180 mounted on a brake bracket 182 which is in turn is pivotably suspended by a pin 184 which connects lower portions of a link plate 186*a* and an identical link plate 186*b*. Upper portions of link plates 186*a* and 186*b* are connected by a pin 188. Upper portions of link plates 186*a* and 186*b* also contain holes 190*a* and 190*b* respectively. Pivotably mounted on pin 188 is an inverted U-shaped bracket 192 from which projects a thumb screw 194. Interior to bracket 192 thumb screw 192 passes through a compression spring 196 and then threads into a nut 198 which is restrained from turning by the sides of bracket 192.

Figure 3D:
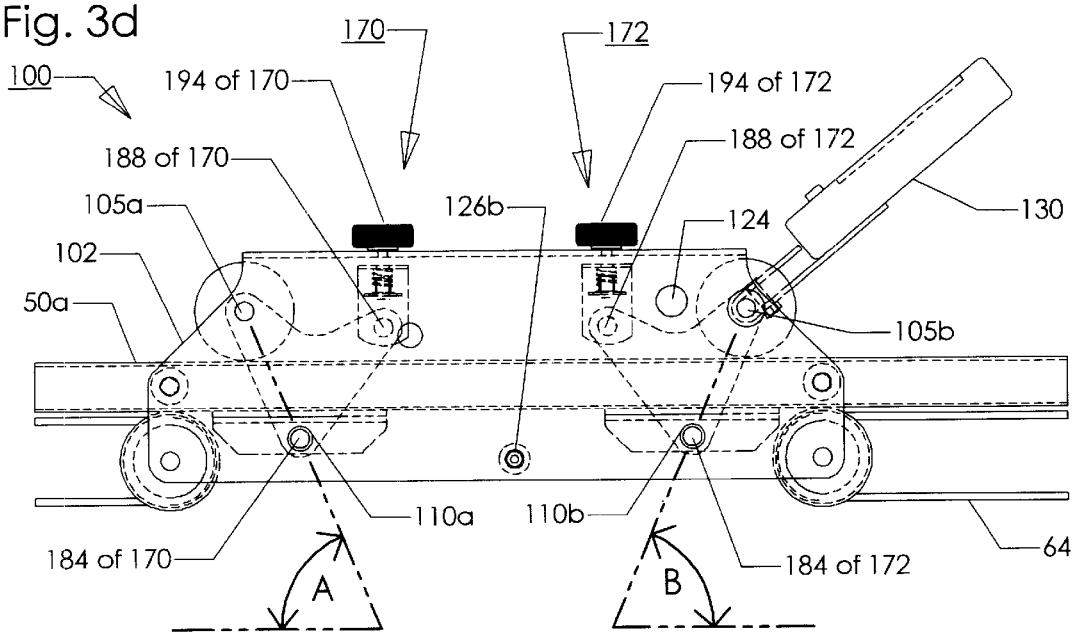
FIG. 3*d* is a side view of the footrest subassembly with components removed to show arrangement of manual resistance subassemblies.

FIG. 3*d* shows the arrangement of manual resistance adjustment subassemblies 170 and 172 in footrest subassembly 100 in the manual resistance adjustment embodiment of the exerciser. Footboards 120*a* and 120*b* and footstraps 122*a* and 122*b* are here removed for clarity. Subassembly 170 is positioned so that axle 105*a* of footrest subassembly 100 passes through holes 190*a* and 190*b* of subassembly 170, with pin 188 of subassembly 170 oriented towards the center of housing 102. Taken together, pin 184, link plate 186*a*, link plate 186*b*, and axle 105*a* form a pivot frame coupling bracket 182 to housing 102.

An acute angle "A" between the contact surface of friction pad 180 when in contact with frame member 50*a* and a plane containing the axes of axle 105*a* and pin 184 (the plane of said pivot frame) of subassembly 170 is equal to 50 to 80 degrees. Manual resistance adjustment subassembly 172 is positioned so that axle 105*b* of footrest subassembly 100 passes through holes 190*a* and 190*b* of subassembly 172, with pin 188 of subassembly 172 also oriented towards the center of housing 102, so pin 188 of subassembly 172 is adjacent to pin 188 of subassembly 170. An acute angle "B" between the contact surface of friction pad 180 when in contact with frame member 50*a* and a plane containing the axes of axle 105*b* and pin 184 of subassembly 172 is equal to 50 to 80 degrees. In the preferred embodiment angles "A" and "B" are both equal to 67 degrees. In both subassemblies 170 and 172, thumb screw 194 bears against the exterior surface of housing 102. Pin 184 of subassembly 170 and pin 184 of subassembly 172 are located to allow their removal through access holes 110*a* and 110*b* respectively, in order to service friction pad 180 of both subassemblies 170 and 172.

One skilled in the art will recognize that the optimum angle for angles A and B is a function of the coefficient of friction of the material selected for brake pad 180. For a given adjustment subassembly, if such angle is too large that subassembly will effectively lock itself to frame member 50*a*. As such angle decreases a more powerful spring 196 is required to generate a given level of working resistance. A more powerful spring would then raise the minimum friction level which can be generated by that subassembly.

Figure 4A:
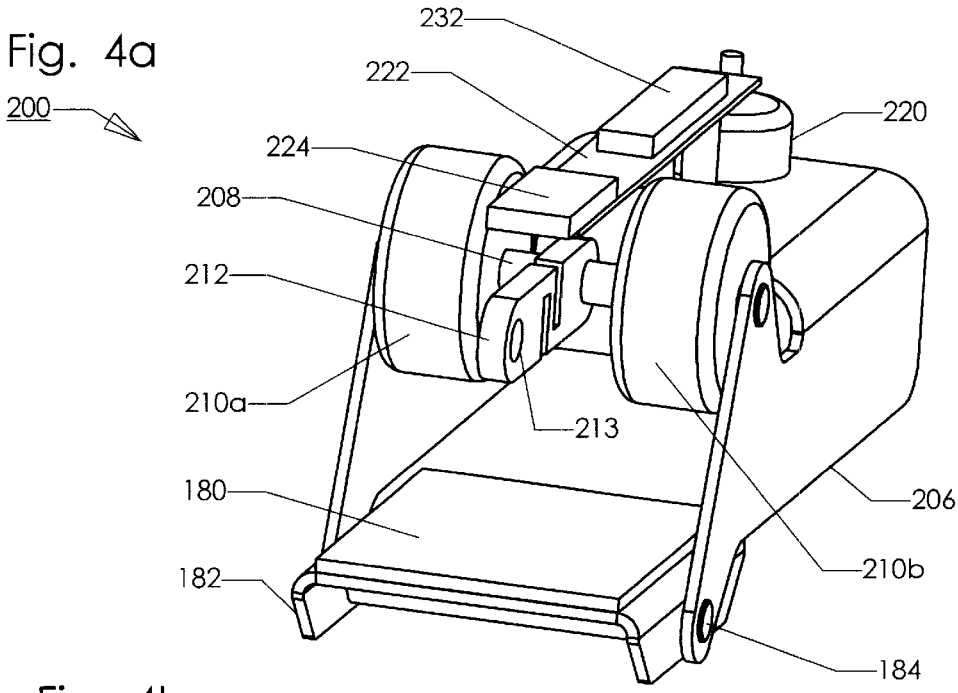
FIG. 4*a* is a detail view of the automatic resistance adjustment subassembly.
Figure 4B:
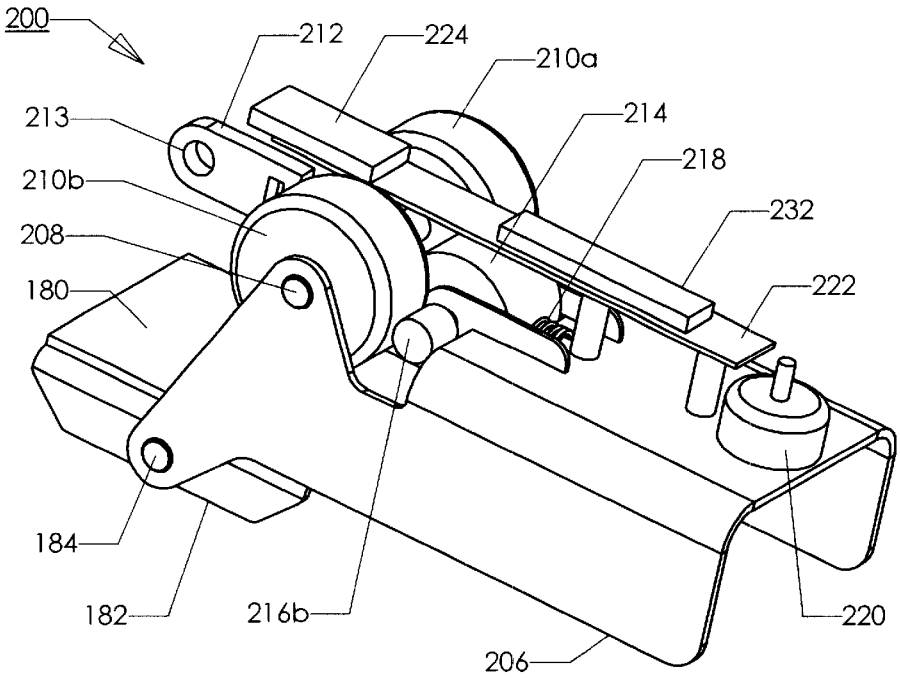
FIG. 4*b* is another detail view of the automatic resistance adjustment subassembly.

FIG. 4*a* and FIG. 4*b* depict complimentary views an automatic resistance adjustment subassembly 200, which contains the same friction pad 180 mounted on brake bracket 182 pivotably suspended by pin 184 as in subassemblies 170 and 172. Here pin 184 connects to a link bracket 206 which in turn connects to an axle 208. A pair of wheels 210*a* and 210*b* rotate on axle 208. Also mounted on axle 208 is a strain gauge 212 incorporating a rear hole 213. An electrical generator 214 sidably attached to link bracket 206 has a pair of drive wheels 216*a* not shown and 216*b*. A compression spring 218 exerts a force from link bracket 206 against generator 214 so that drive wheels 216*a* and 216*b* bear against wheels 210*a* and 210*b* respectively. A force exerting device 220 is mounted at the end of link bracket 206 opposite pin 184. In the preferred embodiment force exerting device 220 is a push type solenoid. The distance between force exerting device 220 and axle 208 is greater than the distance between axle 208 and pin 184 to leverage the effect of force exerting device 220. Also mounted on link bracket 206 is circuit board 222 containing a heart rate receiver 224 which receives a signal from a heart rate transmitter 225 not shown worn by the user, and a controller 232. Circuitry connecting the above components is not shown but will be described with reference to FIG. 7*a*.

Figure 4C:
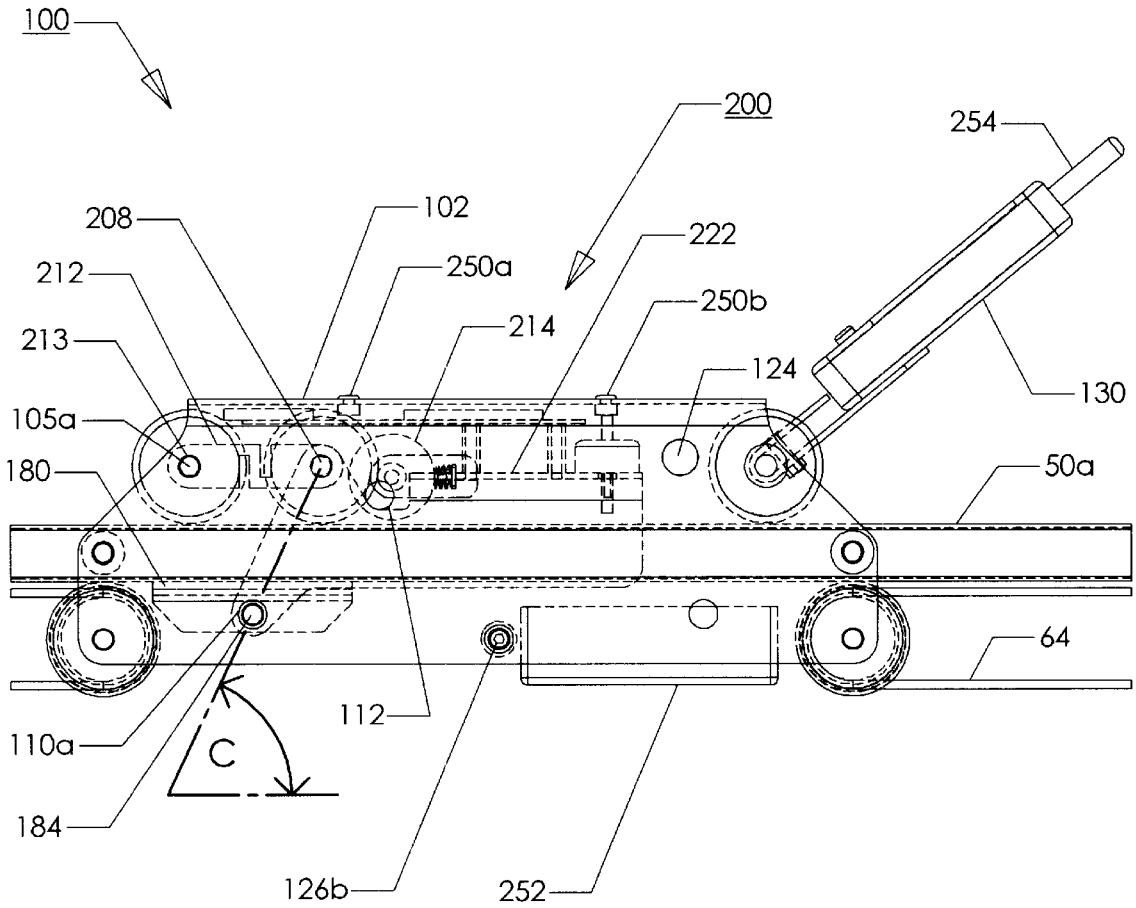
FIG. 4*c* is a side view of the footrest subassembly with components removed to show arrangement of the automatic resistance adjustment subassembly.

FIG. 4*c* shows footrest subassembly 100 equipped with the above automatic resistance adjustment subassembly 200, representing the automatic resistance adjustment embodiment of the exerciser. In footrest subassembly 100 footboards 120*a* and 120*b* and footstraps 122*a* and 122*b* are here removed for clarity. In this embodiment automatic resistance adjustment subassembly 200 replaces both manual adjustment subassemblies 170 and 172 of the manual adjustment embodiment. Here subassembly 200 links to housing 102 where axle 105*a* passes through hole 213 of strain gauge 212. Also incorporated in footrest subassembly in this embodiment are a pair of bumpers 250*a* and 250*b* which occupy the holes in housing 102 through which thumb screw 194 of subassemblies 170 and 172 passed in the manual adjustment embodiment. A battery 252 connects to circuit board 222 and generator 214 by connectors and wires not shown. Projecting from display 130 is an antenna 254 for communication with a remote computer 256 not shown. Pin 184 of subassembly 200 is located to allow its removal through access hole 110*a* in order to service friction pad 180. Access hole 112 allows cleaning of the rolling surfaces of wheels 210*a* and 210*b* and drive wheels 216*a* and 216*b*. An acute angle "C" between the contact surface of friction pad 180 of subassembly 200 when in contact with frame member 50*a* and a plane containing the axes of axle 208 and pin 184 of subassembly 200 is equal to 50 to 80 degrees. In the preferred embodiment angle "C" is equal to 64 degrees.

Figure 5A:
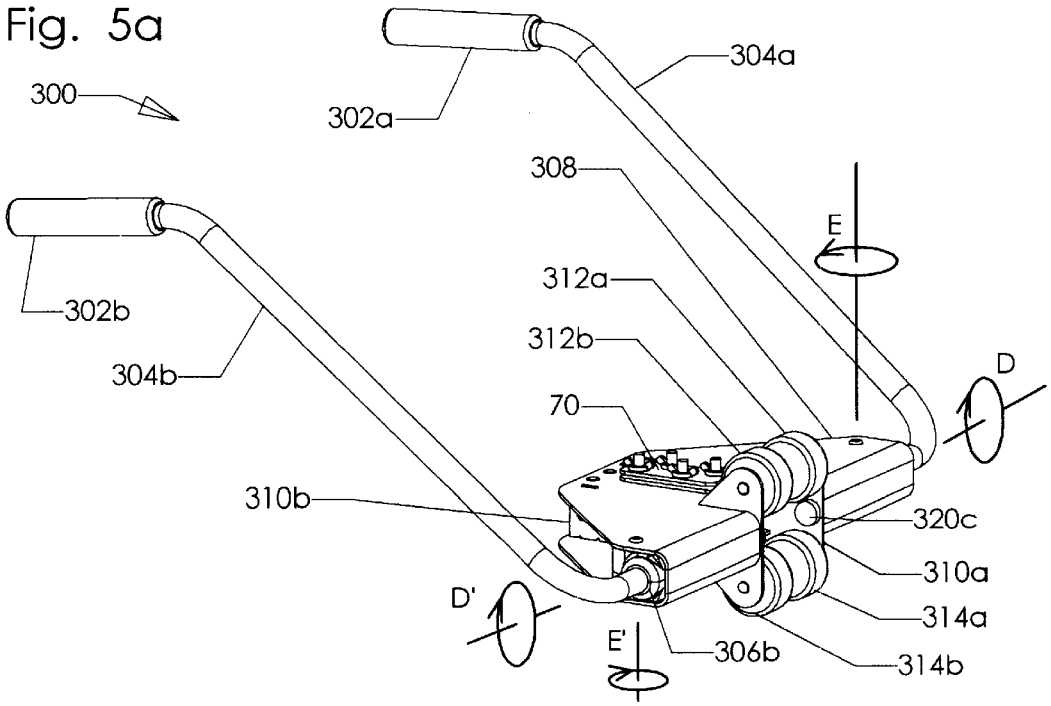
FIG. 5*a* shows the handle subassembly isolated from the exerciser with handles in the operating position.
Figure 5B:
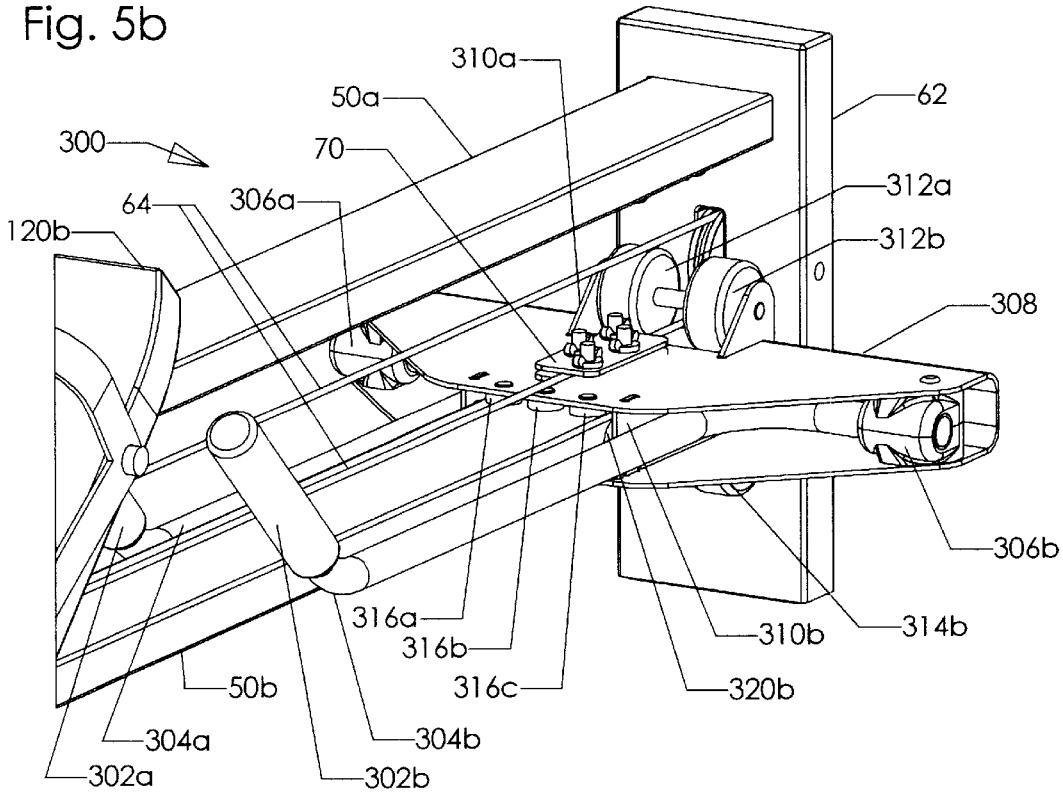
FIG. 5*b* is a detail view of the exerciser with handles in their storage position.

Now referring FIG. 5*a* and 5*b*, handle subassembly 300 consists of a left grip 302*a* and a right grip 302*b* mounted on the first ends of a left tube 304*a* and a right tube 304*b*. The second opposite end of tube 304*a* features a 90 degree bend after which it is rotatably mounted in a pivot block 306*a* with freedom to rotate about an axis D. Likewise the second opposite end of tube 304*b* may rotate in a pivot block 306*b* about an axis D'. Pivot blocks 306*a* and 306*b* in turn rotate within a housing 308 about an axis E and an axis E' respectively. Mounted within housing 308 are a pair of parallel support panels 310*a* and 310*b* which support a set of wheels 312*a* and 312*b* positioned so they may roll on the top surface of frame member 50*b*. Another set of wheels 314*a* and 314*b* are positioned so they may roll on the bottom surface of frame member 50*b*. Also mounted on housing 308 opposite wheels 312*a* and 312*b* are a group of anti-friction pads 316*a*, 316*b*, and 316*c* located to contact the top surface of frame member 50*b*. Mounted below these pads and opposite wheels 314*a* and 314*b* are another group of anti-friction pads 318*a* not shown, 318*b* not shown, and 318*c* not shown located to contact the bottom surface of frame member 50*b*. Also supported by support panels 310*a* and 310*b* are a group of anti-friction pads 320*a* not shown, 320*b*, 320*c*, and 320*d* not shown located to contact the left and right side surfaces of frame member 50*b*. Clamp 70 is mounted on top of housing 308 located to connect to tensile element 64.

FIG. 5*a* shows handle sub-assembly 300 with handles 304*a* and 304*b* deployed in their operating position. FIG. 5*b* shows handle sub-assembly 300 with handles 304*a* and 304*b* rotated about axes D, D', E and E' into their storage position.

Figure 6:
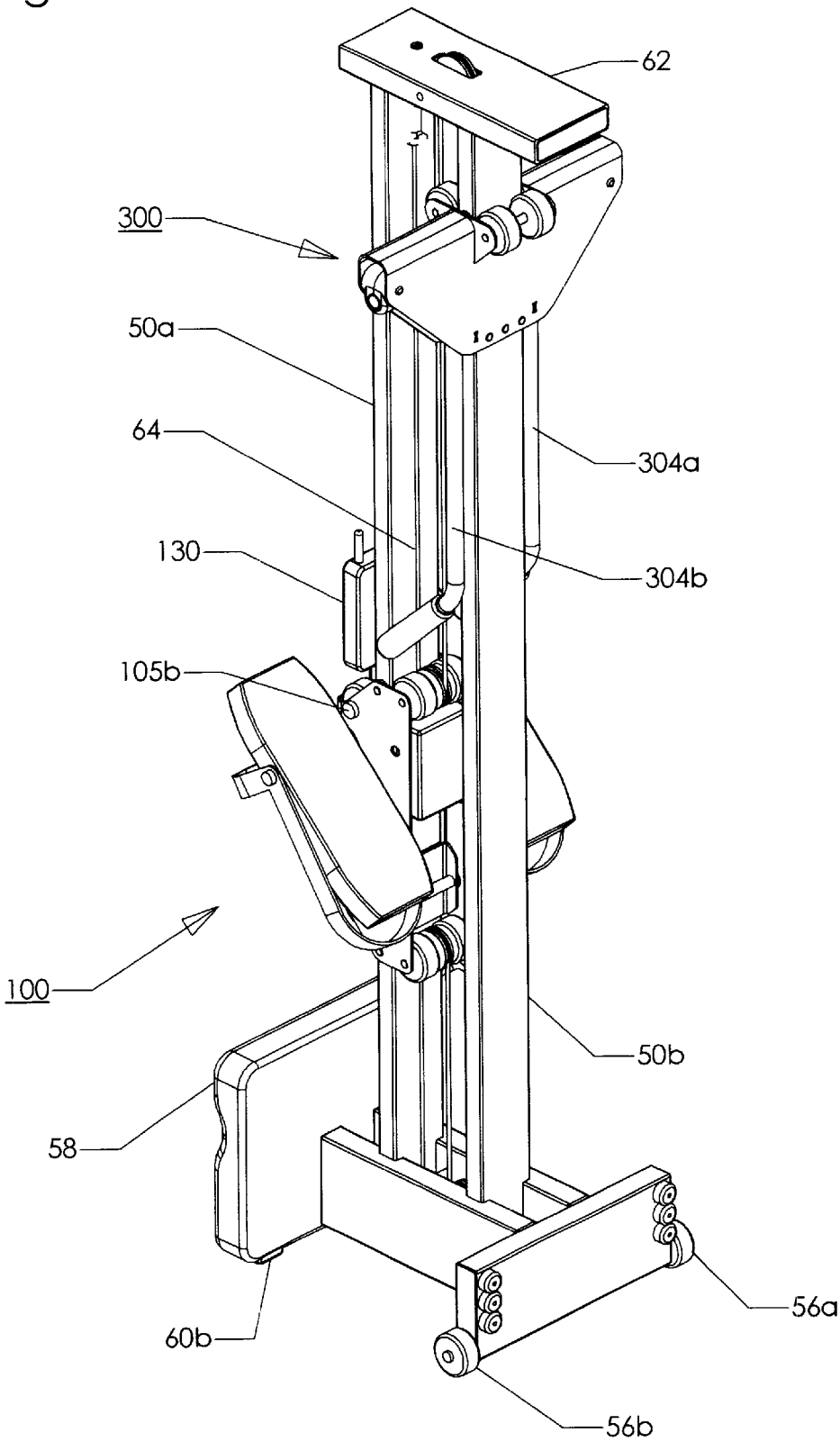
FIG. 6 shows a perspective view of the exerciser in a vertical standing position with the handles and the display in their respective storage positions.

FIG. 6 shows the exerciser in a vertical storage position supported by dolley wheels 56*a* and 56*b* and alternate floor bumpers 60*a* (not shown) and 60*b*. Here handles 304*a* and 304*b* are in their storage position and display 130 is rotated about the axis of pin 105*b* to a storage position where it does not project through a plane defined by the tops of seat 58 and support 62.

Figure 7A:
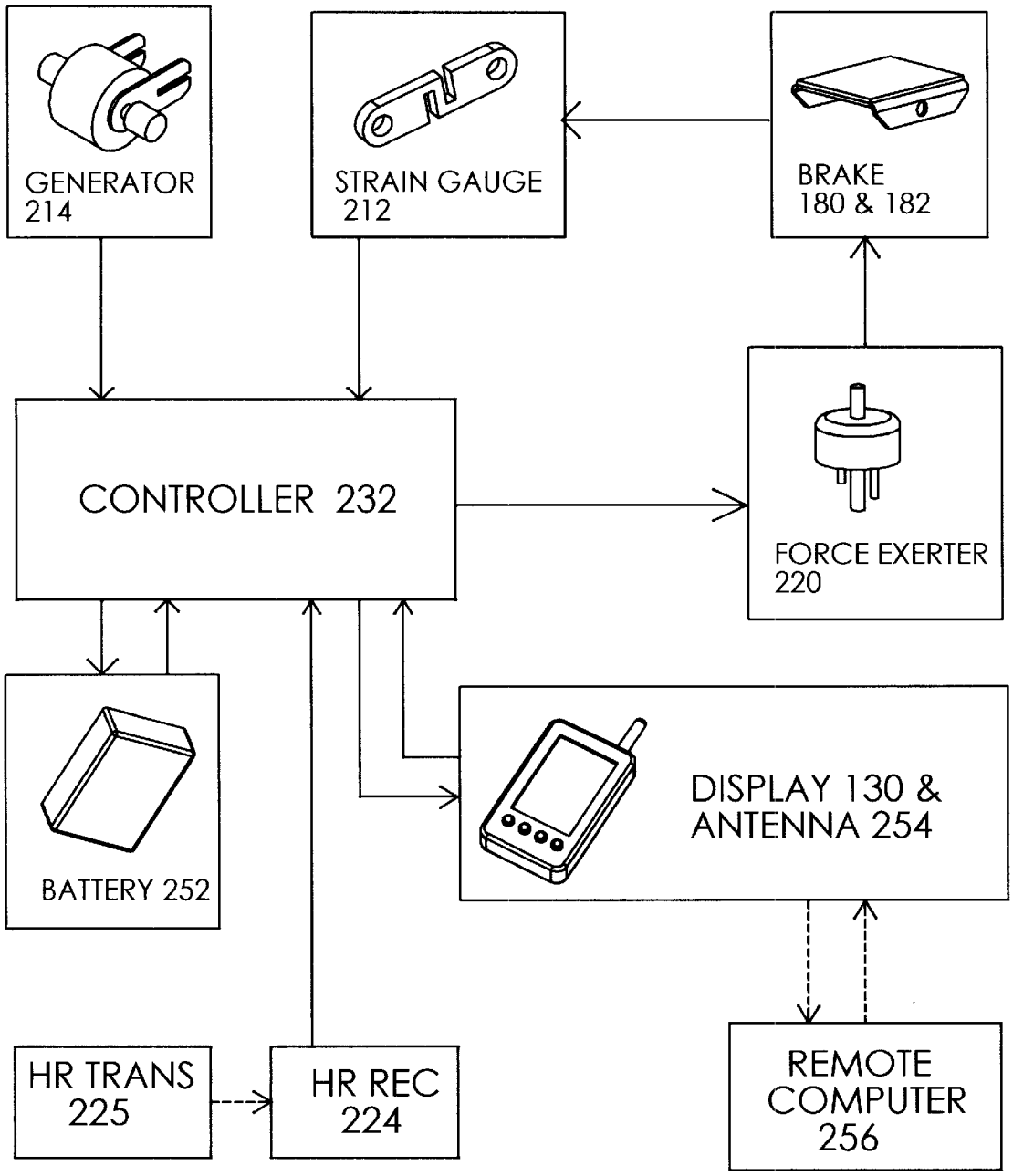
FIG. 7*a* shows a functional layout of electrical components in the automatic resistance adjustment subassembly.

FIG. 7*a* illustrates the electrical and data connections employed by automatic resistance adjustment subassembly 200. Generator 214 transmits electrical power when driven by wheels 210*a* and 210*b* to controller 232 which in turn transmits a non-reversing charging current to battery 252. Controller 232 measures the power output from generator 214, which is proportional to both the speed of rotation of generator 214 and, by common rolling contact with wheels 210*a* and 210*b*, the speed of linear displacement of the entire footrest subassembly 100 with respect to frame member 50*a*. Strain gauge 212 measures the force resisting the linear displacement of footrest subassembly 100 with respect to frame member 50*a* and passes this information to controller 232. The means to convert analog signals from generator 214 and strain gauge 212 into digital form are integral to controller 232. Using the above displacement and force inputs controller 232 then calculates the energy expended by the user in moving housing 102 with respect to frame member 50*a* during a predefined iteration time interval. Subject to control objectives described below, controller 232 then controls the amount of force which force exerter 220 applies against link bracket 206 when pushing away from bumper 250*b*. Battery 252 supplies operating power to controller 232 and display 130, and well as the excitation energy used by force exerter 220. By tending to pivot about axle 208 link bracket 206 magnifies the force applied by exerter 220 and brings it to bear as a normal force acting through brake bracket 182 and brake pad 180 against frame member 50*a*. Subject to the coefficient of friction of brake pad 180, this normal force controls the predominant component of the above resisting force measured by strain gauge 212. The remaining lesser components of the resisting force measured by strain gauge 212 represent the force required to drive generator 214 and other friction forces generated by the exerciser's other moving parts. Controller 232 accumulates and stores in memory data representing user energy expenditure during successive time intervals.

Further referring to FIG. 7*a*, heart rate transmitter 225 transmits data to heart rate receiver 224. In the preferred embodiment transmitter 225 is carried in a chest strap worn by the user in the known way, and signal transmission is by magnetic resonance. Receiver 224 then relays heart rate data to controller 232 where it is accumulated and stored in memory.

Periodically controller 232 passes data representing user energy expenditure, operating cadence, and user heart rate to display 130, where it is displayed graphically and/or numerically in appropriate units during the workout. At the end of each workout session this data is then relayed to remote computer 256 by antenna 254 where it is recorded in a database format in digital storage media. Using this user workout data computer 256 then prepares reports documenting user fitness levels. Antenna 254 also can receive communications from remote computer 256, for example of new workout programs, which antenna 254 then passes to controller 232. Also integral to display 130 are buttons which communicate with controller 232 with which the user can manually initiate, define, modify, and terminate workout programs.

The long term control objectives of controller 232 consist of managing entire workout programs, including: (1) Drive and recovery resistance balanced according to relative muscle group strength with work load adjustment to maintain target user heart rate, (2) Switch between (a) high drive/low recovery resistance and (b) low drive/high recovery resistance when controller 232 senses power drop due to user fatigue, (3) Balanced low resistance steady state aerobic work, (4) Balanced high resistance strength training work, (5) Balanced with alternating high/low resistance intervals, (6) Repeating pattern of balanced low resistance, followed by high resistance on drive only, followed again by balanced low resistance, followed by high resistance on recovery only. The means by which controller 232 executes these workout programs are described below.

The short term control objectives of controller 232 relate to managing resistance within a single operating phase (drive or recovery). These include: (1) Reduction of dynamic shock loading at the beginning portion of each operating phase, and (2) Creation of a desirable kinesthetic momentum or flywheel effect during the remaining portion of each phase.

Figure 7B:
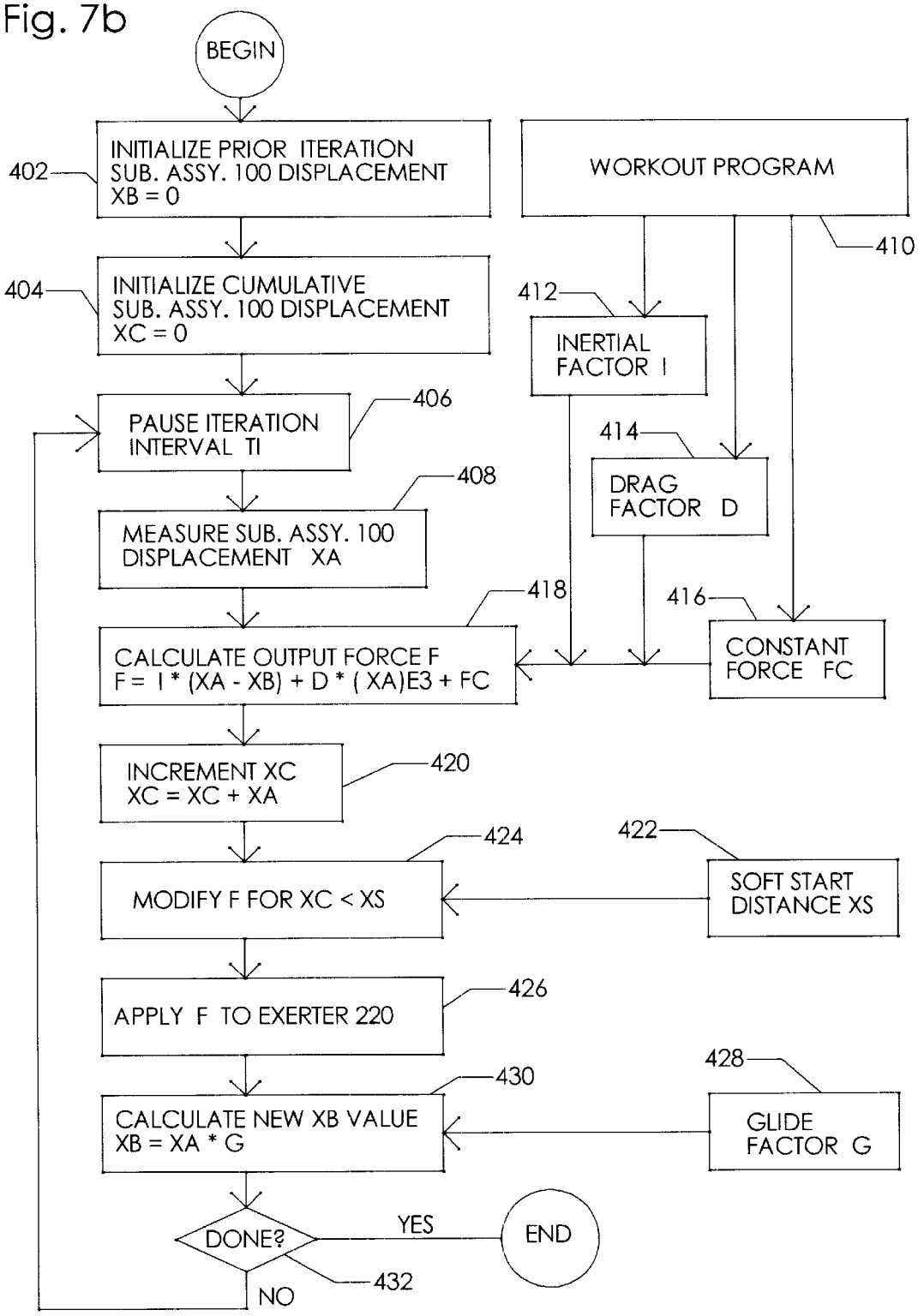
FIG. 7*b* is a flowchart of logic used in the automatic resistance adjustment subassembly to control resistance within each phase of operation.

FIG. 7*b* is a flow chart illustrating how controller 232 achieves these short term objectives on either a drive or recovery phase. A step 402 assigns zero value to a variable "XB" representing the linear displacement of subassembly 100 during a prior iteration interval. A step 404 assigns zero value to a variable "XC" representing the cumulative linear displacement of subassembly 100 since the beginning of the current drive or recovery phase. In a pause 406 controller 232 pauses for an iteration interval "TI". A step 408 records a value "XA" representing the linear displacement of subassembly 100 during pause 406. A step 410 provides workout program data either stored in controller 232 memory, previously input directly by the user or previously transmitted from remote computer 256. A data element 412 provided by workout program 410 is an inertial factor "I" representing acceleration of a virtual mass to generate the above momentum effect. Another data element 414 provided by workout program 410 is a drag factor "D" representing a drag force proportional to displacement XA. A third data element 416 provided by workout program 410 is a constant force value "FC" representing a constant component of the force applied by force exerter 220. A calculation step 418 is an equation of motion which then computes an output force "F" based upon I, D, and FC, assuming the common time interval TI. Here the first term "I*(XA−XB)" represents the virtual mass times its acceleration. In the second term "$D*XA^3$" the quantity XA is raised to the third power to better simulate a viscous resistance.

Further referring to FIG. 7*b*, controller 232 acts to reduce shock loading in a step 420, a step 422, and a step 424. Step 420 increments XC by the current value of XA. Step 422 retrieves from memory a soft start distance "XS". Step 424 proportionally reduces the value of F to the extent XC is less than XS. In the preferred embodiment XS is equal to two inches. In a step 426 Controller 232 then applies output force F to exerter 220. A step 428 then retrieves from memory a glide factor "G" which is a scalar quantity representing the rate at which the virtual mass slows down during interval TI due to external drag. A step 430 then calculates a new value for XB equal to G times the current value of XA. In this way, during each such iteration, in calculation step 418 the XA value represents current iteration displacement and the XB value represents prior iteration displacement adjusted by glide factor G. Finally in a step 432 controller 232 returns to step 406 if the current phase or workout is not over.

FIG. 7*c* is a logic sequence which applies the short term methods described in FIG. 7*b* in the larger context of a complete workout. Here controller 232 manages output force F independently on the drive and recovery. A virtual mass generating drive momentum and a separate virtual mass generating recovery momentum have the effect of simultaneously moving in opposite directions. In this logic sequence workout programs are defined by the following variables:

P=Workout program type 1, 2, 3, 4, 5, or 6;

ID=Inertial factor on drive, analogous to I of FIG. 7*b;*

IR=Inertial factor on recovery, analogous to I of FIG. 7*b;*

D(N)=Drag factor for drive N, scaled to reflect the force magnification resulting from the effect of angle C noted above, analogous to D of FIG. 7*b;*

R(N)=Drag factor on recovery N, analogous to D of FIG. 7*b;*

TEND=Total workout time;

WEND=Total workout work.

D(N) and R(N) are data series wherein a zero value indicates the end of the series. For example, workout type 5 is represented as: D(N)=(low value, high value, low value, low value, zero) and R(N)=(low value, low value, low value, high value, zero). Special forms for workout types 1 and 2 are described below. Other variables used in the FIG. 7*c* logic sequence are:

DD=Current drive phase drag factor D(N)

DR=Current recovery phase drag factor R(N)

F=Control force applied by exerter 220, as in FIG. 7*b*

FC=Base constant force, as in FIG. 7*b;*

G=Glide factor, as in FIG. 7*b;*

HR=Current user heart rate;

FM=Force measured by strain gauge 212, where (+) designates compression (drive) and (−) designates tension (recovery);

N=Drive/recovery cycle count;

TI=Iteration time interval, as in FIG. 7*b;*

TC=Time elapsed from beginning of workout;

X1=Drive displacement during current iteration time interval, analogous to XA of FIG. 7*b;*

X2=Drive displacement during prior iteration interval, analogous to XB of FIG. 7*b;*

X3=Cumulative drive displacement from beginning of drive phase, analogous to XC of FIG. 7*b;*

X4=Recovery displacement during current iteration time interval, analogous to XA of FIG. 7*b;*

X5=Recovery displacement during prior iteration interval, analogous to XB of FIG. 7*b;*

X6=Cumulative recovery displacement from beginning of recovery phase, analogous to XC of FIG. 7*b;*

XS=Soft start distance, as in FIG. 7*b;*

WC=Work done in current drive/recovery cycle,

WMAX=Work done in maximum work drive/recovery cycle;

WT=Total work done since beginning of workout.

Now referring to FIG. 7*c*, a series of lines 500, 510, 520, 530, and 540 assign a zero initial value to TC, WC, WMAX, X2, and X5. Setting X2=0 here is analogous to step 402 of FIG. 7*b*. A line 550 sets N=1. A line 580 is the beginning of a drive/recovery cycle iteration loop setting WC=0. A line 585 resets N=1 if the series D(N) yields a zero value indicating end of series. A line 600 is the beginning of a drive phase iteration loop setting X3=0, analogous to step 404 of FIG. 7*b*. At a line 605 controller 232 pauses for time interval TI, analogous to step 406 of FIG. 7*b*. A line 610 reads the current value of FM. A line 615 then skips ahead to a line 700 if the user is in a recovery phase rather than a drive phase. A line 620 records X1, representing the linear displacement of subassembly 100 during the pause at line 605, analogous to step 408 of FIG. 7*b*. A line 625 then increments WC by the quantity FM*X1, representing the amount of work done during displacement X1. A line 630 retrieves a DD value from a subroutine at a line 900, analogous to step 414 of FIG. 7*b*. An equation 635 is the drive phase equation of motion analogous to step 418 of FIG. 7*b*. A line 640 then increments X3 by X1, analogous to step 420 of FIG. 7*b*. A line 645 then implements the soft start feature of steps 422 and 424 of FIG. 7*b*, so that if X3 is less than XS then F is reduced by a factor X3/XS, but not to less than FC. Line 650 applies the resulting value of F to exerter 220, analogous to step 426 of FIG. 7*b*. While X2 was initially set equal to zero at line 530, a line 655 then sets X2=G*X1, a value which will apply in subsequent iterations through equation 635, analogous to steps 428 and 430 of FIG. 7*b*. Line 660 then sets X5=G*X5, having the effect of decelerating the recovery virtual mass during the drive phase. A line 665 skips to a line 850 if workout time has expired and a line 670 skips to a line 850 if workout work has expired. At a line 675 controller 232 then skips to a line 700 if the absolute value of FM is less than a minimum quantity, indicating the user is at a phase transition. A line 680 then returns to line 600 completing the drive phase iteration loop.

A recovery phase iteration loop at a series of lines 700–780 corresponds numerically to the above drive phase iteration loop at lines 600–680, except there is no line corresponding to line 615. In the line 700–780 loop variables DD, X4, X5, and X6 replace DR, X1, X2, and X3, and vice-versa, respectively. Line 760 sets X2=X2*G, having a reciprocal effect of decelerating the drive virtual mass during the recovery phase. The phase transition test at line 775 skips to a line 800.

For the case of workout program type 2, line 800 sets WMAX equal to the highest value of WC generated since initialization or reset of WMAX=0. A line 805 then increments WT by WC. A line 810 then displays WC and HR for the just ended drive/recovery cycle. A line 815 records in memory the current TC, WC and HR value for later reporting. For workout types other than 1 and 2 a line 820 then increments N by 1. A line 825 marks the end of the drive/recovery cycle and returns to line 580 to begin the next cycle. At the end of the workout line 850 then displays all workout results on display 130. Finally, a line 855 transmits those results to remote computer 256.

For workout programs other than type 1 and type 2 the subroutine beginning at line 900 goes to a line 950 and returns DD=D(N) and DR=R(N).

In the special case of workout type 1, workout drag factors are in the form D(N)=(base drag factor on drive, drag adjustment coefficient for drive, heart rate minimum) and R(N)=(base drag factor on recovery, drag adjustment coefficient for recovery, heart rate maximum). Here, if HR is greater than or equal to the heart rate minimum D(3) and less than or equal to the heart rate maximum R(3), then a line 905 returns DD=D(1) and DR=R(1). For heart rates below the minimum D(3) value, a line 910 returns DD adjusted by factor D(2) and the quantity D(3)/HR and DR adjusted by factor R(2) and the quantity D(3)/HR. Similarly, for heart rates above the maximum R(3) value, a line 915 returns DD adjusted by factor D(2) and the quantity R(3)/HR and DR adjusted by factor R(2) and the quantity R(3)/HR.

Workout type 2 reverses drive and recovery intensity levels when user work output falls below defined threshold levels. In this case workout drag factors are in the form D(N)=(high value, low value, fatigue threshold percent) and R(N)=(low value, high value, zero). For this workout type, if WMAX=0, a line 930 goes to line 950, indicating it is in an initial drive phase following WMAX initialization or reset. Then a line 935 also goes to line 950 if controller 232 is in the drive phase (FM>0), so that intensity reversal only occurs following a complete drive/recovery cycle. Finally, in a line 940, if WC is less than WMAX times threshold D(3) the value of N switches from 1 to 2 and vice-versa to reverse drive and recovery intensity levels. Line 950 then returns DD=D(N) and DR=R(N).

Operation

In its operating position the exerciser is supported by bumpers 62*a* and 62*b* and support 62. The user sits on seat 58 and places his/her feet on footboards 120*a* and 120*b* within footstraps 122*a* and 122*b*. The user's hands grasp grips 302*a* and 302*b*. During the drive phase of operation the user extends his/her legs so footrest subassembly 100 moves away from seat 58 and pulls with his/her hands so handle subassembly 300 moves towards seat 58. As noted above, handle subassembly 300 moves in the opposite direction and substantially twice the distance as footrest subassembly 100. The drive phase employs the user's extension muscle groups in the legs and lower torso and flexion muscle groups in the upper torso and arms. The recovery phase is the reverse, so it employs the user's flexion muscle groups in the legs and lower torso (abdominals) and extension muscle groups in the upper torso and arms.

Operation of Manual Resistance Adjustment

In the manual resistance adjustment embodiment illustrated in FIG. 3*d*, thumb screw 194 of adjustment subassembly 172 substantially controls resistance during the drive phase. Here, with reference to components of adjustment subassembly 172, thumb screw 194 adjusts the force compression spring 196 applies to generate a small initial torque on link plates 186*a* and 186*b* which tends to rotate them about axle 105*b* so brake pad 180 is brought to bear against the underside of frame member 50*a*. The orientation and magnitude of angle B greatly compound this initial torque in response to the user moving footrest subassembly 100 in the drive direction. This positive feedback effect occurs because the friction force transmitted through brake pad 180 during the drive phase acts in concert with that of compression spring 196, thus further increasing the normal force on brake pad 180, which in turn further increases the friction force itself. However during the recovery phase the friction force reverses direction and tends to rotate link plates 186*a* and 186*b* the other way so brake pad 180 is pulled away from frame member 50, in opposition to spring 196 force. Therefor during the recovery phase friction force generated by adjustment subassembly 172 does not exceed that which results from spring 196 force alone.

In similar fashion thumb screw 194 of adjustment subassembly 170 substantially controls resistance during the recovery phase. Here link plates 186*a* and 186*b* tend to rotate about axle 105*a* rather than 105*b*, and the orientation and magnitude of angle A govern the positive feedback effect.

Because the muscle groups used during the drive phase are typically stronger than those used during the recovery phase, a user typically sets adjustment subassembly 172 for higher resistance than subassembly 170. At low levels this will provide a balanced total body workout for maximum cardiovascular benefit. However a user may wish to vary these settings in accordance with other training goals. For example, setting subassembly 170 for high resistance provides a strength training exercise isolating the abdominal muscles.

Operation of Automatic Resistance Adjustment

Referring again to FIG. 4*c*, in the automatic resistance adjustment embodiment of the exerciser subassembly 200 controls resistance during both the drive and recovery phases. Here the acute angle C faces in the same direction as angle B of manual resistance adjustment subassembly 172 in order to most efficiently provide more resistance during the drive phase than the recovery phase, in accordance with the relative strength of different muscle groups. An alternative embodiment of the exerciser may contain two subassemblies 200 facing in opposite directions as do subassemblies 170 and 172 in the manual adjustment embodiment. Controller 232 independently adjusts resistance during the drive and recovery phases. Here the action of force exerter 220 is analogous to spring 196 of the manual adjustment subassemblies. Controller 232 also functions to reduce start-up shock loading at the beginning of each phase, provide a desirable kinesthetic momentum effect, and provide a drag force which simulates viscous resistance.

Alternative Embodiments

While the above description of the exerciser illustrates its preferred embodiments numerous alternative methods and structures falling within the scope of the invention can be developed by those skilled in the art. Such alternative methods and structures include:

A. The ratio of footrest subassembly 100 movement to handle subassembly movement may be other than 2:1.

B. Exerter 220 may be a piezo-electric element rather than a solenoid.

C. Some or all functions ascribed to controller 232 may reside in display 130.

D. The spring rate of spring 196 in manual resistance adjustment subassembly 170 may differ from that in subassembly 172.

E. In a lower cost embodiment, strain gauge 212 in automatic resistance adjustment subassembly 200 may be eliminated. In this case for calculation of work done FM would be defined as a empirical function F and workout program type 2 would be eliminated. Generator 214's signal would be used to determine phase and phase changes.

F. In a further automatic resistance adjustment embodiment, footrest subassembly 100 may comprise two automatic resistance adjustment subassemblies oriented to maximize resisting force in opposite directions as do manual resistance adjustment subassemblies 170 and 172 in the manual resistance embodiment.

G. Glide factor G may be variably defined by alternative workout programs rather than constant.

H. The equation of motion at lines 635 and 735 of FIG. 7*c* may be replaced by other functional means, for example a lookup table defining F as a function of X1 and X2 on the drive or X3 and X4 on the recovery.

I. The drag term $D^*(XA)^3$ at step 418 of FIG. 7*b*. may raise XA (or X1 at line 635 and X4 at line 735 of FIG. 7*c*) to a power other than three.

J. Resistance means mounted on handle subassembly 300.

K. Frame member 50*b* not parallel to frame member 50*a*.

L. Frame member 50*b* above frame member 50*a*.

M. Where pulley 66*a* may be driven by tensile element 64, one skilled in the art may construct analogous resistance subassemblies opposing rotary motion of pulley 66*a*.

The scope of the invention should be determined by the appended claims and their legal equivalents rather than by the above examples.

What is claimed is:

1. A total body exerciser for providing independently adjustable resistance to both extension and flexion muscle groups comprising:

a frame comprising a fixed seat portion and a group of at least two longitudinal members;

a footrest carriage slidably mounted to at least one said longitudinal member and having a pair of footrests;

a handle carriage slidably mounted to at least one other said longitudinal member;

a flexible tensile element constraining sliding motion of said footrest carriage and said handle carriage in response to user applied force so that as said footrest carriage moves closer to said seat portion said handle carriage moves farther from said seat portion and as said footrest carriage moves farther from said seat portion said handle carriage moves closer to said seat portion; and at least one user controllable resisting means opposing sliding motion of footrest carriage and handle carriage.

2. An exerciser as defined in claim 1 in which said flexible tensile element is fixed to said handle carriage and bears against and turns approximately one hundred and eighty degrees around a pulley means mounted on said footrest carriage, so the ratio of said handle carriage speed with respect to said seat portion is approximately twice said footrest carriage speed with respect to said seat portion.

3. An exerciser as defined in claim 1 in which said user controllable resisting means comprises:

a resistance means generating a variable force opposing said sliding motion;

a motion sensing device sensing the speed and direction of said sliding motion;

a force sensing device sensing the magnitude of said force opposing said sliding motion;

a logic controller receiving input data from said motion sensing device and said force sensing device and acting to change said force opposing said sliding motion according a predetermined user objective, thereby providing a closed feedback loop.

4. An exerciser as defined in claim 3 in which said motion sensing device is an electrical generator driven by said sliding motion which also provides electrical power.

5. An exerciser as defined in claim 3 further containing a heart rate signal receiver linked to said logic controller.

6. An exerciser as defined in claim 3 in which said logic controller further contains a means to record and transmit a data set representing aggregations of output from said force sensing device to a remote data processing device.

7. An exerciser as defined in claim 6 in which said logic controller further contains a means to receive and record a data set representing said predetermined user objective from said remote data processing device.

8. A process employing an exercise device as defined in claim 6 in which said remote data processing device aggregates said data sets, calculates summaries of such data sets, and maintains said summaries in a user accessible medium.

9. An exerciser as defined in claim 1 in which said user controllable resisting means contains:

a pivot frame containing a first pivot axis and a second pivot axis which are substantially parallel to each other, where said pivot frame is pivotably mounted about said first pivot axis to a first element of the exerciser;

a friction inducing member pivotably mounted to said pivot frame about said second pivot axis of said pivot frame so that said friction inducing member bears against a second element of the exerciser which moves relative to said first element of the exerciser in response to a user applied force, causing a friction force resisting a sliding motion between said first and second elements of the exerciser, where said first and second axes of said pivot frame are substantially perpendicular to the direction of said sliding motion at a point, where said first and second axes of said pivot frame are substantially parallel to a plane of contact between said friction inducing member and said second element of the exerciser, and where an angle between a plane substantially containing both said first and second axes of said pivot frame and said plain of contact is an acute angle; and a user controllable device exerting a force on said pivot frame urging a reduction in said acute angle.

10. An exerciser as defined in claim 9 in which said acute angle is between 50 and 80 degrees.

11. An exerciser as defined in claim 9 in which said user controllable device exerting a force on said pivot frame is a user deflectable spring.

12. An exerciser as defined in claim 9, further containing a motion sensing device sensing the speed and direction of said sliding motion and a force sensing device sensing the magnitude of said friction force opposing said sliding motion, in which a logic controller receiving input data from said motion sensing device and said force sensing device changes the magnitude of force exerted by said device exerting a force on said pivot frame according to a predetermined user objective, thereby providing a closed feedback loop.

13. An exerciser as defined in claim 12 in which said motion sensing device is an electrical generator driven by said sliding motion which also provides electrical power.

14. An exerciser as defined in claim 12 further containing a heart rate signal receiver linked to said logic controller.

15. An exerciser as defined in claim 12 in which said logic controller further contains a means to transmit and record a data set representing aggregations of output from said force sensing device to a remote data processing device.

16. An exerciser as defined in claim 15 in which said logic controller further contains a means to receive and record a data set representing said predetermined user objective from said remote data processing device.

17. A process employing an exercise device as defined in claim 15 in which said remote data processing device aggregates said data sets, calculates summaries of such data sets, and maintains said summaries in a user accessible medium.

* * * * *